United States Patent [19]

Stahlecker et al.

[11] Patent Number: 4,571,932

[45] Date of Patent: Feb. 25, 1986

[54] FRICTION SPINNING ROLLER ARRANGEMENT

[75] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[73] Assignees: Hans Stahlecker; Fritz Stahlecker, both of Fed. Rep. of Germany

[21] Appl. No.: 626,929

[22] Filed: Jul. 2, 1984

[30] Foreign Application Priority Data

Jul. 2, 1983 [DE] Fed. Rep. of Germany ..... 3323988

[51] Int. Cl.[4] ..... D01H 1/135; D01H 7/882

[52] U.S. Cl. ..... 57/401; 57/335; 57/408

[58] Field of Search ..... 57/334, 335, 401, 408, 57/409

[56] References Cited

U.S. PATENT DOCUMENTS

| | | | |
|---|---|---|---|
| 4,168,601 | 9/1979 | Didek et al. | 57/401 |
| 4,334,400 | 6/1982 | Fehrer | 57/401 X |
| 4,420,928 | 12/1983 | Fehrer | 57/401 |

*Primary Examiner*—John Petrakes

*Attorney, Agent, or Firm*—Barnes & Thornburg

[57] ABSTRACT

An open-end friction spinning arrangement is disclosed with two adjacently arranged rollers driven in the same rotational direction and forming a wedge-shaped yarn forming gap with their cover surfaces. It is provided that the cover surfaces of at least one of the rollers is designed such that it includes different axial zones in the area of the yarn formation region and in the yarn withdrawal direction, in which different radial forces and/or different rotational speeds act upon the yarn being produced.

25 Claims, 12 Drawing Figures

FRICTION SPINNING ROLLER ARRANGEMENT

BACKGROUND AND SUMMARY OF THE INVENTION

The invention relates to an arrangement for open-end friction spinning with two adjacently arranged rollers driven in the same rotational direction and having cover surface areas which together form a wedge-shaped yarn forming gap. The wedge-shaped gap has a narrowing area serving as the yarn formation region. A fiber inlet and opening device supplies fiber material in the form of single separated fibers to the wedge-shaped gap. A yarn withdrawal device is provided for drawing off the produced yarn in the longitudinal direction to the wedge-shaped gap.

With an arrangement of the kind mentioned above disclosed in German Published Unexamined Application (DE-OS) No. 24 49 583, the supplied single fibers are simultaneously pressed against the two cover surface areas of the rollers by means of which they are spun to form a yarn which is drawn off in the longitudinal direction of the wedge-shaped gap. The yarn, simultaneously pressed against the two cover surface areas within the narrowing area of the wedge-shaped gap is retained against the withdrawal force introduced by the yarn withdrawal device by means of the friction force occurring between the produced yarn and these roller cover surface areas. On the one hand it is desired to produce the highest possible tensile forces during the drawing off of the produced yarn since this directly increases the tenacity of the yarn being produced. On the other hand, an increase in the tensile forces increases the danger that yarn end, or so called yarn tip, being formed is irregularly stretched resulting in what has been described as decoupling. These delays or irregularities exhibit themselves as thickened and thinned portions along the length of the produced yarn.

Futhermore, it is quite frequently discovered that an increased twisting is observed in the thinned sections within the yarn.

With another arrangement disclosed in German Published Unexamined Application (DE-OS) No. 28 10 184, the yarn formation does not occur in the narrowed area of the wedge-shaped gap, but within the area of the smallest distance between the cover surface areas of the two rollers. It has been contemplated with such an arrangement to provide these cover surface areas with elevations in such a manner that the wedge-shaped gap extends in the area of its narrowest portion in a wavy line, while said cover surface areas jointly comb the yarn without touching each other. With this arrangement, where the yarn to be produced is not simultaneously pressed together through the cover surface areas of the two rollers, the construction of the wedge-shaped gap as being wave-like in shape is to prevent that the open yarn end being produced does not move back and forth during yarn formation.

It is an object of this invention to provide an arrangement of the above-mentioned kind which makes it possible to work with a higher tensioning force within the yarn end that is being produced while at the same time the danger of stretching or decoupling within the yarn being produced is decreased.

This object is achieved according to the invention by providing that the cover surface area of at least one of the friction rollers is designed to provide for sequential zones in the region of yarn formation in the direction of the yarn withdrawal, in which zones different radial forces and/or different rotational speeds act upon the yarn being produced.

It was established that by these measures, the yarn being produced can be spun with a surprisingly higher tensioning withdrawal force, while at the same time the danger with respect to occurrences of thinning/thickening portions is decreased. Furthermore, an increased twisting is not produced in the thinning portions that occassionally occur.

In a preferred embodiment of the invention, it is provided that the cover surface area of at least one of the rollers is provided with zones in the area of the mouth of a fiber feed channel. These zones are then provided only in those areas in which fibers are still to be spun in the yarn being produced.

In another embodiment of the invention, the cover surface area of at least one of the rollers includes one or more circumferential grooves. These grooves permit the change of the axial compression of the produced yarn and the transfer of twist by means of different rotational speeds whereby at the same time the tension force can be increased.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
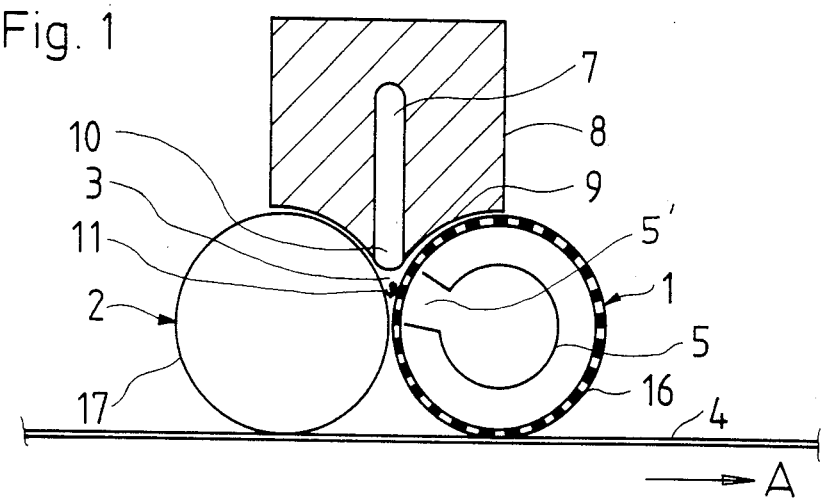
FIG. 1 is a schematic cross-sectional view of the area of the friction rollers of a spinning arrangement constructed according to the invention.

In order not to obscure the present invention, in the drawings and in the following description, only those features of an open-end friction spinning machine are shown and described which are deemed necessary to teach one skilled in the art to make and use the present invention.

Figure 2:
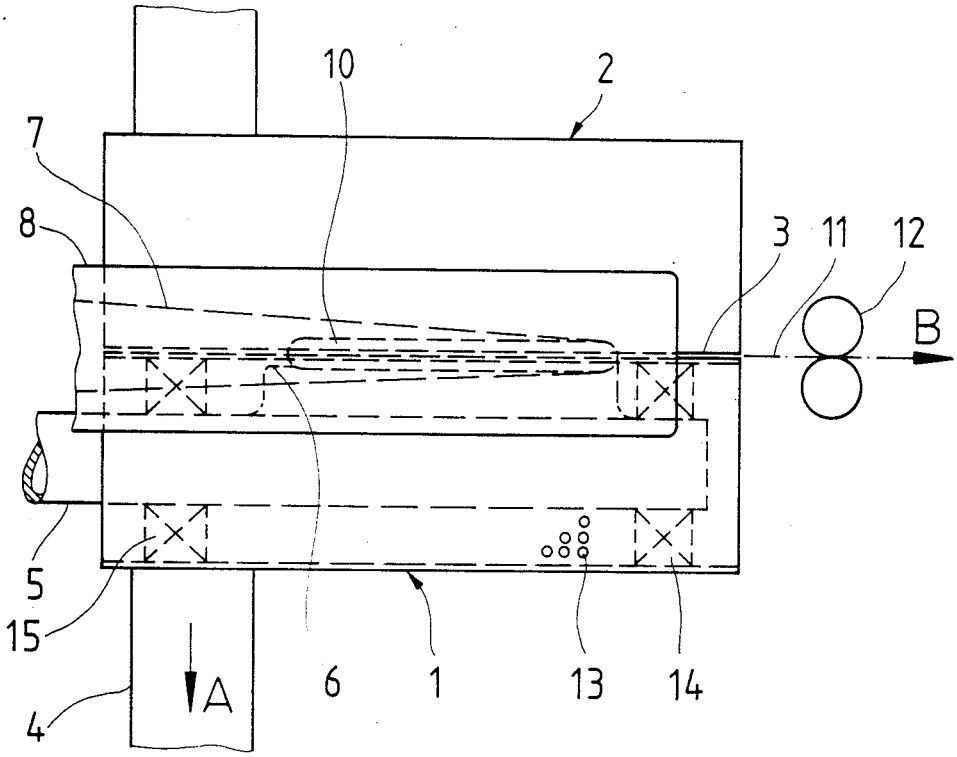
FIG. 2 is a top schematic view of the arrangement according to FIG. 1.

The arrangement schematically illustrated in FIGS. 1 and 2 includes two adjacently arranged rollers 1 and 2 with cover surface areas 16 and 17 forming a narrowing or tapering wedge-shaped gap 3. The cover surface areas 16 and 17 of the two rollers 1 and 2 are directly driven in the same rotational direction by a tangential belt 4 which runs in arrow direction A in the longitudinal direction through a spinning machine equipped with a plurality of such spinning arrangements. Due to travel direction A of the tangential belt 4, cover surface area 16 of roller 1 rotates into the wedge-shaped gap 3, while cover surface area 17 of roller 2 rotates out of the wedge-shaped gap 3.

The roller 1 is constructed as a so-called suction roller. This roller includes a suction insert 5 which is connected to a sub-pressure (below ambient pressure)

source described here in no further detail. This suction insert 5 contains a slot opening 5' which is directed towards the area of wedge-shaped gap 3. Cover surface area 16 is perforated so that a suction air stream is produced in the area of wedge-shaped gap 3. With the aid of this suction air stream, fibers that were opened to single fibers are supplied via a fiber feed channel 7 which starts from a not further illustrated inlet and opening device and which, with a fiber feed channel mouth 10, is disposed opposite to the wedge shaped gap 3. The inlet and opening device corresponds to the one utilized with open-end rotor spinning machines. The groove-like fiber feed channel 7 extends essentially in the direction of the wedge-shaped gap and is arranged in a housing part 8 which exhibits a profile 9 corresponding to the circumference of the cover surface areas 16 and 17 and partially covering same. The supplied fibers are spun within the tapered area of the wedge-shaped gap 3 and are then drawn off in direction B in the longitudinal direction of the wedge-shaped gap 3 via a yarn withdrawal roller pair 12 to be subsequently taken up onto a spool in a manner not further illustrated here.

The roller 2 rotating out of wedge-shaped gap 3 is also arranged as a suction roller corresponding to roller 1, which means it includes a perforated cover surface area 17 and is provided with a suction insert directed towards the area of wedge slot 3. It is, however, also contemplated to provide embodiments with this roller 2 having a closed cover surface area 17. The two rollers 1 and 2 are advantageously supported by means of roller bearings 14 and 15, preferably at tube-shaped suction insert 5.

FIGS. 3 through 12 show different embodiments of the invention for the construction of the cover surface areas 16 and 17 of rollers 1 and 2. All of the embodiments have sequentially arranged axial zones of the roller surface areas which are configured to effect different radial forces and/or rotational speeds acting on the fibers and the yarn being produced. In the preferred embodiments, provision of these zones in the region of the mouth 10 of the fiber feed channel in the so-called fiber dispersion or feeding zone is sufficient. In order to differentiate the various embodiments of FIGS. 3 to 12, letter suffixes A, B, . . . are added to the drawing reference characters for generally similar but different structural features.

Figure 3A:
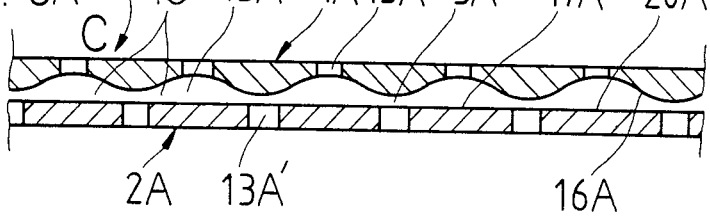
FIGS. 3 through 12 are respective axial sectional views through the area of the wedge-shaped gap formed by the two friction rollers, wherein the rollers comprise different cover surface areas according to respective different preferred embodiments of the invention.

In the embodiment according to FIG. 3, roller 1A, indicated by arrow C as rotating into wedge-shaped gap 3, includes a cover surface area with perforations 13A. Circumferential grooves 19 with a round cross-section are provided at the outer region of cover surface area 16A. It is thereby provided that the holes of perforation region 13A respectively are located in the area of the groove bottoms. The sections having a round cross-section and remaining between the grooves 19 are convexly rounded or curved so that a wave-like profile results. The cover surface area 17A of roller 2A is also provided with perforations 13A', but has a smooth, cylindrical shape. In the area of the projections or section between the ring grooves 19, yarn 11 being produced is pressed together in the there tapering/narrowing wedge-shaped gap 3 more strongly so, than in the area of ring grooves 19, in which said yarn 11 is able to stretch somewhat. Furthermore, the projections between grooves 19 exhibit a much higher circumferential speed than the bottom of the grooves 19 so that a stronger twisting force on the forming yarn occurs at these points. The individual zones with the different effects follow directly one after the other, so that despite these different zones, an even effect is obtained by means of which uniform twisting of the yarn is assured while at the same time a higher yarn withdrawing tension is possible without increasing the danger of yarn irregularities/decoupling. The drawing figures illustrate the actual measurements in an enlarged or exaggerated size or scale. The depth of grooves 19 are approximately in the range of 0.5 to 1.5 mm. The width of grooves 19 amounts to between 6 and 20 mm.

With the embodiment according to FIG. 3, it is provided that the holes 13A' of the perforation region of the cylindrical roller 2A are arranged in rows opposite the projections between grooves 19 of the roller 1A. Embodiments are also contemplated where the perforations are arranged in such a manner that the holes of the perforation lay opposite the groove bottoms of the other roller 1A. The grooves 19 with the shown embodiment extend in a radial plane. It is further contemplated to provide embodiments with a continuous groove arranged spirally upon the coated area 16A of roller 1A. In order to further increase the yarn tensioning pulling force, it is provided that the spiral grows continuously against the yarn withdrawal direction B so that a certain conveyor effect is exercised upon the producing yarn end which is directed against the yarn withdrawal direction. By means of increasing the pull or tensioning force within the yarn being produced, the so-called spinning tension, the tenacity of the yarn is thereby increased.

Figure 4B:
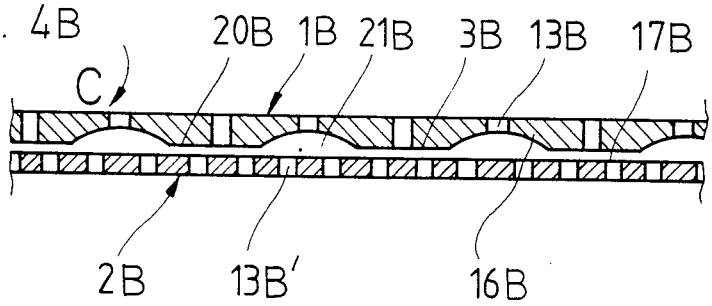

With the embodiment according to FIG. 4, coated area 16B of roller 1B rotating into wedge-shaped gap 3 is provided with perforations 13B and with ring grooves 21B revolving in radial planes or a single ring groove extending in a spiral manner. The projections 20B remaining between the ring grooves 21B form cylinder surfaces, the axial length of which correspond to approximately the axial length of ring grooves 21B having a round cross-section. Roller 2B rotating out of wedge-shaped gap 3 exhibits a cylindrical cover surface area 17B provided with perforations 13B'. With this embodiment, perforations 13B' are not only provided for the area of the groove bottoms but also in the area of projections 20B. The yarn being produced is more strongly pressed together over a greater axial length with regard to this embodiment as compared to the FIG. 3 embodiment because of the larger area of projections 20B in which cover surface area 16B features a greater circumferential speed than in the area of the grooves 21B where the yarn is able to stretch out somewhat. In the event a single or plural-flight spiral groove is used, the spinning tension is influenced both by the direction and the length or pitch of the spiral. It is desirable, for example, when spinning a long staple fiber material to especially increase the spinning tension so that the pitch of the spiral is directed against the yarn withdrawal direction. On the other hand, it can be advantageous with short staple fiber material to somewhat reduce the spinning tension so that under these circumstances the pitch of the spiral is directed toward the yarn withdrawal direction, thereby supporting the yarn withdrawal by a conveyor effect of the spiral groove 21B.

Figure 5C:
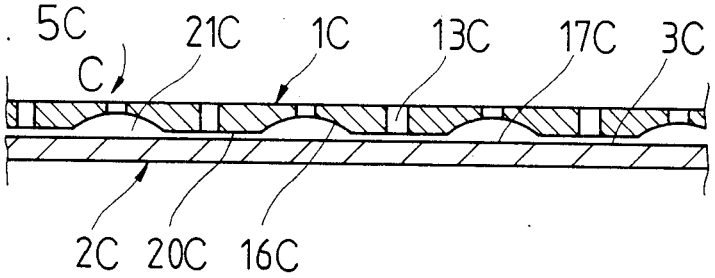

In a variation of the embodiment according to FIG. 4, it is provided with the embodiment according to FIG. 5 that roller 2C rotating out of wedge-shaped gap 3 includes a closed, not perforated, cover surface area 17C. In principle, this will lead to the same effect as with the embodiment according to FIG. 4, however, the friction is altogether somewhat decreased between the two rollers 1C and 2C.

Figure 6D:
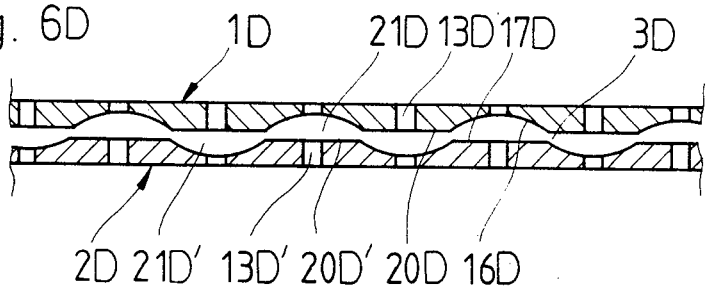

With the embodiment according to FIG. 6, the coated areas 16D and 17D of the two rollers 1D and 2D are arranged identically, which means the coated area 16D and 17D include ring grooves 21D and 21D' with a round cross-section and protrusions 20D and 20D' remaining in between with cylindrical outer surfaces having a length approximately corresponding to the length of the grooves 21D and 21D'. The cover surface areas 16 and 17 are provided with perforations 13D and 13D' not only in the area of the groove 21D and 21D', but also in the area of protrusions or projections 20D and 20D'. Both rollers 1D and 2D, however, are disposed with respect to each other in such a manner that a projection 20D, 20D' of one roller 1D are located respectively opposite to a groove 21D, 21D' of the other roller 2D. The strongest compression of the yarn occurs in the area of the respective facing edges of grooves 21D and 21D' and projections 20D, 20D'. In the intermediate area, the yarn is able to somewhat stretch itself, as with the other embodiments, leading to the advantage that the fiber connection is again somewhat loosened so that fibers are more easily tied up in the yarn being produced.

Figure 7E:
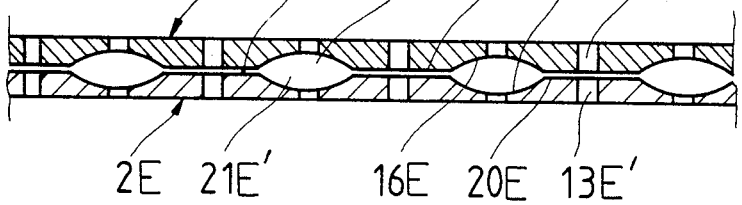

In the embodiment according to FIG. 7, the rollers 1E, 2E correspond in their construction to the embodiment according to FIG. 6 in that cover surface areas 16E and 17E of the rollers 1E and 2E are both provided with grooves 21E and 21E' having a round cross-section and separated by projections 20E and 20E' formed by intermediate cylindrical surfaces. Holes of perforations 13E and 13E' are provided in the area of projections 20E and 20E' as well as in the area of the bottom of the grooves. The two rollers 1E and 2E, however, are so disposed with respect to each other that grooves 21E and 21E' each respectively face projections 20E and 21E'. The space available for opening the yarn is thereby doubled, while at the same time the stronger compression and rotation with higher circumferential speed occurs over a longer axial area then in the embodiment of FIG. 6.

Figure 8F:
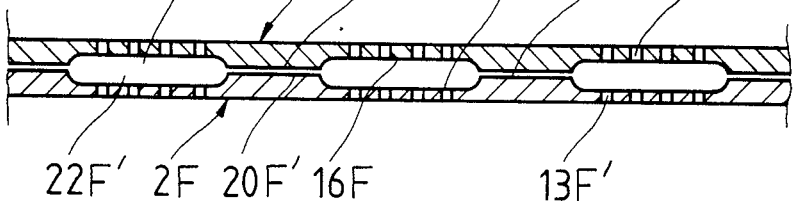

The embodiment according to FIG. 8 also includes two rollers 1F and 2F with similar covered surface areas 16F and 17F. The covered surface areas 16F and 17F include circumferential grooves 22F and 22F' and projections 20F and 20F' therebetween. Grooves 22F and 22F' are arranged opposite each other and have a cylindrical bottom extending in the axial direction and in a straight line, which bottoms connect respectively via rounded sections to the projections 20F and 20F'. With this embodiment, the holes of perforations 13F and 13F' are provided only in the area of grooves 22F and 22F' so that protrusions 20F and 20F' therebetween exhibit a closed cylindrical surface. Protrusions 20F and 20F' are slightly shorter in the axial direction than grooves 22F and 22F'. The regions of the strongest twisting, based upon the smallest distance between rollers are located between projections 20F and 20F', the effects of which, however, are so modified that in their areas no sub-pressure exists drawing the yarn being produced to cover surface areas 16F and 17F. The desired effects can be adjusted with this embodiment by shifting cover surface areas 16F and 17F of rollers 1F and 2F in the axial direction with respect to each other as similarly described in the embodiment according to FIGS. 6 and 7.

Figure 9G:
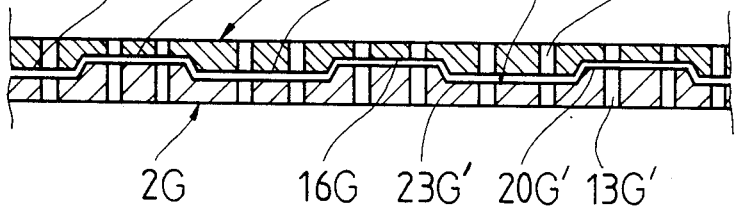

With the embodiment according to FIG. 9, grooves 23G and 23G' are provided in the cover surface areas 16G and 17G of rollers 1G and 2G having a cylindrical groove bottom in the axial direction and which extend with sloped border surfaces into cylindrical surface projections 20G and 20G' remaining therebetween. Cover surface areas 16G and 17G are provided with perforations 13G and 13G' which are evenly distributed over grooves 23G, 23G' and projections 20G, 20G'. Thereby rollers 1G and 2G are so arranged that a projection 20G or 20G' each fits into a groove 23G or 23G' respectively positioned opposite thereof. Although a constant distance between covering surface 16G and 17G of rollers 1G and 2G over the entire axial length is provided, different yarn compression forces occur in the area of the sloped groove bordering walls facing each other respectively. Additionally, zones with a different rotational speed are the result since protrusions 20G and 20G' show a higher circumferential speed than zones at the bottom of grooves 23G and 23G'.

Figure 10H:
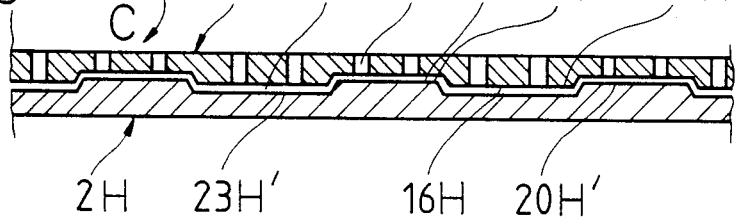

The embodiment according to FIG. 10 corresponds essentially to the embodiment according to FIG. 9 with the exception that cover surface area 17H of roller 2H rotating out of wedge-shaped slot 3 is closed and does not include perforations. Thereby the friction effect is altogether somewhat modified. Also with the embodiment according to FIGS. 9 and 10, the depth of the grooves are chosen in the range of 0.5 to 1.5 mm, while the width of grooves 23G, 23H, 23G', 23H' and corresponding protrusions 20G, 20H have an axial length in the range of 6 to 20 mm, chosen in dependence on the fiber material and the yarn denier number to be spun.

Figure 11I:
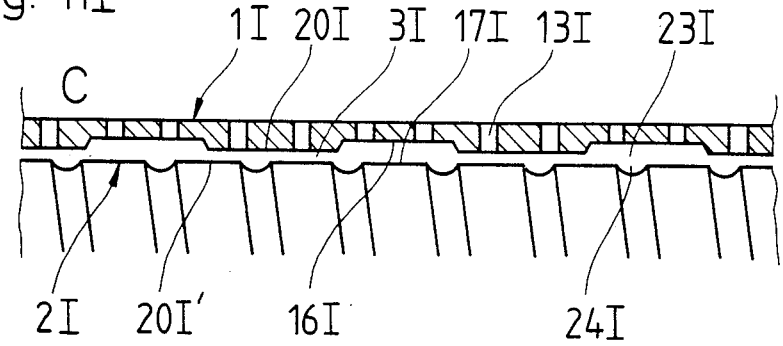

With the embodiment according to FIG. 11, the cover surface area 16I of the roller 1I rotating into wedge-shaped gap 3 is provided with grooves 23I having a straight cylindrical bottom and projection 20I positioned therebetween, which groove bottom and projections have the same axial length. Perforations 13I are evently distributed over projection 20I and grooves 23I. Roller 2I rotating out of wedge-shaped gap 3 includes a closed cover surface area 17 having a spirally extending groove 24 inbetween which projection 20I' extends. Grooves 23I and grooves 24 do not correspond to each other so that a statistical irregularity in the effect occurs upon the yarn to be produced. The grooves 24 having a rounded cross-section contain an essentially smaller axial extension than the grooves 23I. They are preferably arranged in the form of a single or multiple spiral.

Figure 12J:
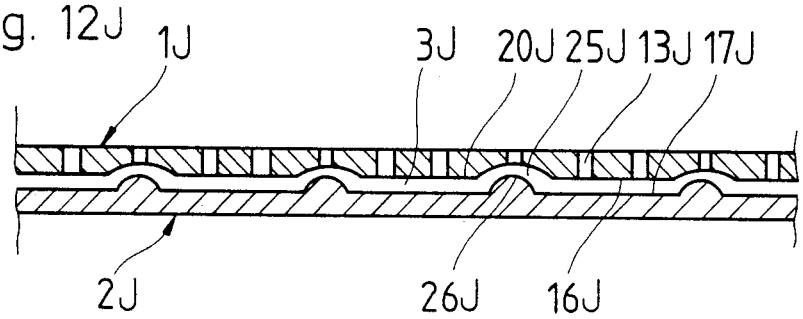

With the embodiment according to FIG. 12, cover surface area 16 of roller 1 rotating into wedge-shaped gap 3 is provided with perforations and grooves 25 having a rounded cross-section which have a smaller axial extension when compared to the projections 20J therebetween. This extension of grooves 25 is about half of the extension of projection 20J. The cover surface area 17 of roller 2J rotating out of wedge-shaped gap 3 is closed. Roller 2J is provided with projection 26 which are convexly rounded and are positioned opposite to grooves 25. These projections are dimensioned such that they just fit into grooves 25. This embodiment not only effects the application of different radial pressure in the area of grooves 25 and projection 26 upon the yarn being produced, but also different rotational speeds are transferred to the yarn.

In principle, it is noted that with all embodiments, the depth of the grooves, their axial length, and also the size of the projections are dependent upon the fiber material and the desired yarn count. It can be said, that with fine yarns, the measurements are smaller than with coarser yarns.

The embodiments, especially those according to FIGS. 3, 4, 5, 6, 7, 8 and 11 which include widenings in the area of wedge-shaped gap 3, have not only the advantage that the yarn is somewhat opened, and thereby newly arrived fibers are more easily accepted, but also the advantage that occassionally occurring impurities as, for example, shell particles or the like can drop out through the widened gap areas. It is thereby noted that the smallest distance between rollers 1 and 2 are about 0.02 mm in practice and thus there is the danger that small shell particles could extend between rollers 1 and 2 and could possible jam the two rollers.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An arrangement for open end friction spinning of yarn comprising:

two friction rollers rotably drivable in the same direction and disposed adjacent one another to form a yarn forming wedge-shaped gap therebetween, fiber supplying means for supplying individual fibers to the wedge shaped gap, yarn withdrawal means for withdrawing yarn from the wedge-shaped gap in the longitudinal direction of said wedge-shaped gap, and differential radial force means for applying differential radial force to the forming yarn at different alternatingly arranged axial zones of the wedge-shaped gap, said alternatingly arranged axial zones comprising a cyclical arrangement of high and low radial force zones.

2. An arrangement according to claim 1, wherein each friction roller has a cover surface area which operatively engages the yarn as it is being formed into yarn in the wedge-shaped gap, and wherein the differential radial force means includes different configured cover surface area zones in at least one of the friction rollers.

3. An arrangement according to claim 2, wherein the fiber supplying means includes a mouth opening to the wedge shaped gap along a fiber feeding axial length of the friction rollers and wherein the differently configured cover surface area zones are disposed along the fiber feeding axial length of the friction rollers.

4. An arrangement according to claim 2, wherein the differential radial force means, includes circumferential groove means in the cover surface area of at least one of the friction rollers.

5. An arrangement according to claim 4, wherein said groove means extends spirally around the cover surface area of the at least one of the friction rollers.

6. An arrangement according to claim 4, wherein the groove means exhibits a pitch against the yarn withdrawal direction of the yarn being produced.

7. An arrangement according to claim 4, wherein the groove means contains a bottom section extending in a straight line in the axial direction of the respective roller associated therewith.

8. An arrangement according to claim 7, wherein the groove means is bordered with a sloped groove wall.

9. An arrangement according to claim 7 wherein the groove means is bordered with a rounded groove wall.

10. An arrangement according to claim 4, wherein the groove means exhibit a rounded cross-section.

11. An arrangement according to claim 10, wherein the area between grooves of the grooved means are convexly arched.

12. An arrangement according to claim 4, wherein the cover surface area of at least one of the rollers is perforated in the area of the bottom groove means.

13. An arrangement according to claim 4, wherein the cover surface area of at least one of the rollers is closed outside of the bottom of the groove means.

14. An arrangement according to claim 4, wherein the groove means have a width of 6 to 20 mm.

15. An arrangement according to claim 4, wherein the groove means have a depth of about 0.5 to 1.5 mm.

16. An arrangement according to claim 15, wherein the groove means have a width of 6 to 20 mm.

17. An arrangement according to claim 4, wherein the axial distance between the groove means approximately corresponds to the width of the groove means.

18. An arrangement according to claim 4, wherein the cover surface of the roller rotating into the wedge shaped gap is provided with single or multiple rotating grooves forming said groove means.

19. An arrangement according to claim 4, wherein the roller rotating out of the wedge-shaped gap is provided with a smooth cover surface area.

20. An arrangement according to claim 18, wherein the roller rotating out of the wedge-shaped gap is provided with a smooth cover surface area.

21. An arrangement according to claim 4, wherein the roller rotating out of the wedge-shaped gap exhibits a closed cover surface area.

22. An arrangement according to claim 4, wherein the cover surface areas of both rollers are provided with at least one circumferential groove forming the groove means.

23. An arrangement according to claim 22, wherein the grooves of the cover surface areas of the two rollers are arranged respectively opposite each other.

24. An arrangement according to claim 22, wherein the grooves of the cover surface areas of the two rollers are arranged respectively offset with respect to each other in the axial direction of the rollers.

25. An arrangement according to claim 4, wherein both rollers are provided with groove means and wherein the groove means of the cover surface area of one roller are offset in the axial direction with respect to the groove means of the cover surface area of the other roller so that a groove of one roller is opposite a groove dividing projection of the other roller.

* * * * *